US006941581B1

(12) United States Patent
England et al.

(10) Patent No.: US 6,941,581 B1
(45) Date of Patent: Sep. 13, 2005

(54) ADJUSTABLE CAP

(76) Inventors: Karen Ann England, 39 E. Galvez Ct., Pensacola Beach, FL (US) 32561; Robert L. England, 39 E. Galvez Ct., Pensacola Beach, FL (US) 32561

( * ) Notice: Subject to any disclaimer, the term of this patent is extended or adjusted under 35 U.S.C. 154(b) by 0 days.

(21) Appl. No.: 10/334,965

(22) Filed: Dec. 31, 2002

(51) Int. Cl.[7] ..... A42B 1/00
(52) U.S. Cl. ..... 2/195.2
(58) Field of Search ..... 2/195.1–195.4, 2/10, 181, 175.1

(56) References Cited

U.S. PATENT DOCUMENTS

| | | | | | |
|---|---|---|---|---|---|
| 2,194,043 | A | | 3/1940 | Jacobi | 2/197 |
| 4,274,157 | A | | 6/1981 | Boden | 2/181.4 |
| 4,815,148 | A | | 3/1989 | Satterfield | 2/197 |
| 4,941,210 | A | * | 7/1990 | Konucik | 2/171 |
| 5,384,916 | A | | 1/1995 | Portney | 2/195.2 |
| 5,402,538 | A | | 4/1995 | Conrad | 2/195.2 |
| 5,509,145 | A | * | 4/1996 | Stevenson et al. | 2/195.1 |
| 5,584,076 | A | | 12/1996 | Armstrong | 2/195.2 |
| 5,724,676 | A | | 3/1998 | Amendolia et al. | 2/195.2 |
| 5,754,983 | A | * | 5/1998 | Landers | 2/195.1 |
| 5,887,289 | A | * | 3/1999 | Theoret | 2/425 |
| 5,903,921 | A | * | 5/1999 | Dow | 2/12 |
| 5,966,742 | A | | 10/1999 | Cunliffe | 2/195.3 |
| 6,049,911 | A | * | 4/2000 | Bromberg | 2/195.3 |
| 6,094,749 | A | | 8/2000 | Proctor | 2/195.2 |
| 6,119,273 | A | | 9/2000 | Cho | 2/195.3 |
| 6,363,537 | B1 | | 4/2002 | Park | 2/181 |

* cited by examiner

*Primary Examiner*—Katherine M Moran
(74) *Attorney, Agent, or Firm*—Peter Loffler

(57) ABSTRACT

An adjustable cap uses a coarse sizing system such as providing the dome of the cap with a pair of straps and placing a buckle on one of the straps and mating the other strap within the buckle, providing cooperating hook and loop material on each strap, providing cooperating prongs and corresponding receptacles on the straps, etc., which sizing system is static and provides the overall coarse sizing for the cap. A fine sizing system has one of the straps being made from two sections with one of the sections being made from an elastic material. This latter system provides continuous fine sizing adjustments.

13 Claims, 3 Drawing Sheets

ADJUSTABLE CAP

BACKGROUND OF THE INVENTION

1. Field of the Invention

The present invention relates to an adjustable cap that provides both coarse and fine size adjustments.

2. Background of the Prior Art

People's heads come in all sizes. Accordingly, hats, and specifically caps that are worn by such people must accommodate the variety of head sizes. There are three major methods for sizing a cap for a specific person's head.

The first sizing method calls for each cap to be made in a size specific for the particular wearer. While such a method, which gives each cap wearer a custom size hat, is ideal from a comfort level, it is not realistic from a manufacturing and inventory point of view. As there are a large variety of head sizes, a retailer of caps would need to keep a large inventory of sizes in order to accommodate every potential customer. Additionally, the manufacturer would need to produce a large variety of sizes of each hat that it produces resulting in huge tooling costs. Except for very expensive custom made hats for the person for whom money is no object, having a hat that is made precisely in the size needed by a particular wearer is not economically feasible. In order to overcome the problems of exact size caps, manufacturers produce caps in a few sizes in much the same manner that shoe manufacturers produce shoes. A person simply chooses a hat that is closest to his head size and wears that hat. The problem with this method is that very few people have a head size that matches the size of the hat that they wear. Accordingly, most people wear a hat that is slightly too big or slightly too small, resulting in less than a completely comfortable fit. Although not as extensive as with custom hat sizes, this method also creates manufacturing and inventory problems for the manufacturer and retailer respectively, as a relatively large number of each type of hat produced and sold is needed.

In order to overcome the above problems, hats that have sizing features have been developed. In such a method a person buys a hat and sizes the hat to the size that is most comfortable. This relieves the manufacturer and retailer of having to manufacture and stock a large number of hat sizes for each type of hat that is made and sold. One type of sizing system is the well known prong system wherein the back of the cap has a pair of straps located at the back proximate the lower periphery of the cap. One strap has a plurality of male prongs thereon, while the second strap has a plurality of female protrusions thereon for receiving the prongs of the first strap. The cap is sized by having more (smaller hat size) or less prongs (larger hat size) received within the receptacles. This system works reasonably well but it too has only a finite sizing ability and tends to leave most wearers with a cap that is slightly too large or slightly too small. To address this problem, sizing methods have been proposed that give a near infinite number of sizes that can be achieved. Such methods include placing cooperating hook and loop material on each of the straps and using the hook and loop material to mate the two straps to the exact size desired by the wearer. Another method uses a buckle on one of the straps with the other strap being received within the buckle and the buckle clamped closed on this other strap when the desired size is achieved. These methods give a wearer a more perfect size fit but they fail to account for the fact that a person's head swells and shrinks somewhat during the course of a day which means that the person's hat will be at times slightly too big and at other times slightly too small resulting in a less than perfect level of comfort during hat wear. A person can make size adjustments throughout the day as his head shrinks and swells, however, this is inconvenient and results in a person needing to feel discomfort in order to appreciate that it is time to resize the cap.

A method has been proposed to address the problem of head shrinking and swelling as they relate to hats. Such method uses a band of resilient material, such as an elastic band, around the lower periphery of the cap. The resilient material allows the wearer's head to expand and contract while maintaining the hat snugly about the wearer's head. This method provides a very comfortable fit, yet it suffers from the same problems associated with custom fit hats described above. Specifically, the hat employing a resilient member must be sized near the user's head in order to be effective. A hat that is initially too big will not fit irrespective of the resilient member and a hat too small will be too tight irrespective of the resilient member. Therefore, the retailer is again faced with the problems of stocking a large number of caps in varying sizes for each type of cap sold and the manufacturer faces the problem of having to tool up to make this large number of hats in varying sizes.

Therefore, there exists a need in the art for a cap that is comfortable to wear by a person of any given head size and that allows the person's head to shrink and swell throughout the hat wearing day, which cap overcomes the above mentioned problems found in the art. Specifically such a cap must be comfortable to almost all wearers and at all times of the day without the need to adjust the size during wear. Such a cap must not require that a retailer stock a large number of caps of various sizes for each type of cap sold and, correspondingly, must not require a manufacturer to produce caps in a wide variety of sizes. Such a cap must be of simple design and construction and must be relatively easy to use.

SUMMARY OF THE INVENTION

The adjustable cap of the present invention addresses the aforementioned needs in the art. The adjustable cap is comfortable to wear by a person of any given head size and allows the person's head to shrink and swell throughout the hat wearing day with the hat adjusting to the head's resizing without the need for the wearer to resize the cap. The adjustable cap does not require that a retailer stock a large number of caps of various sizes for each type of cap sold and, correspondingly, does not require a manufacturer to produce caps in a wide variety of sizes. The adjustable cap is of relatively simple design and construction and is be relatively easy to use.

The adjustable cap of the present invention is comprised of a dome having a lower periphery and an opening located at the lower periphery. A first strap is attached to the dome proximate the opening, the first strap having a first section made from an elastic material and a second section, while a second strap is attached to the dome proximate the opening and oriented in spaced apart fashion relative to the first strap, the second strap may have a third section that is made from elastic material and a fourth section, the first strap and the second strap being releasably mateable with each other. The dome may have a first pocket located proximate the lower periphery and openable into the opening such that a portion of the first strap is disposed within the first pocket and is attached to the dome within the first pocket, which portion may be some or all of the first section. A second pocket may be located proximate the lower periphery and openable into the opening such that a portion of the second strap is disposed within the second pocket and is attached to the dome within the second pocket, which portion may be some or all of the third section. The first strap may be mateable with the second strap by providing cooperating hook and loop material on each strap or the first strap may be mateable with the second strap by providing a buckle on one of the first strap or the second strap and having the other strap received within the buckle or the first strap may be mateable with the second strap by providing at least one prong on one of the first strap or the second strap and proving a plurality of receptacles on the other strap such that the at least one prong is receivable within at least one of the plurality of receptacles.

BRIEF DESCRIPTION OF THE DRAWINGS

Similar reference numerals refer to similar parts throughout the several views of the drawings.

DESCRIPTION OF THE PREFERRED EMBODIMENT

Figure 1:
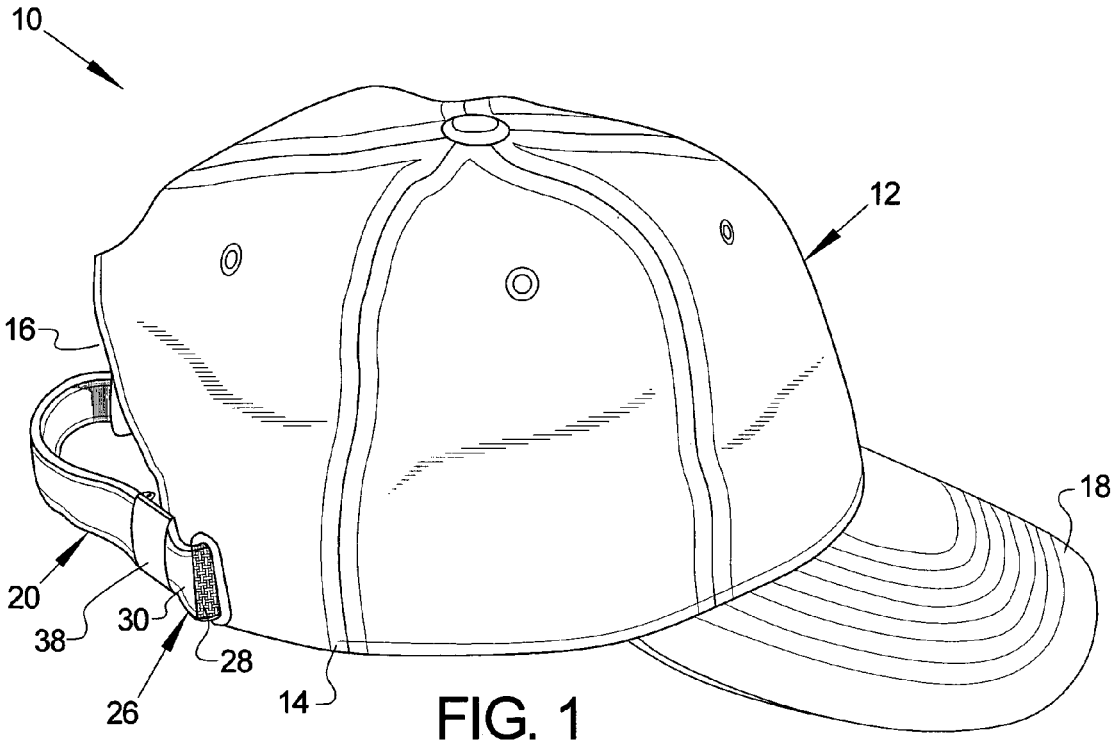
FIG. 1 is a right side perspective view of the adjustable cap of the present invention with the two straps coupled.
Figure 2:
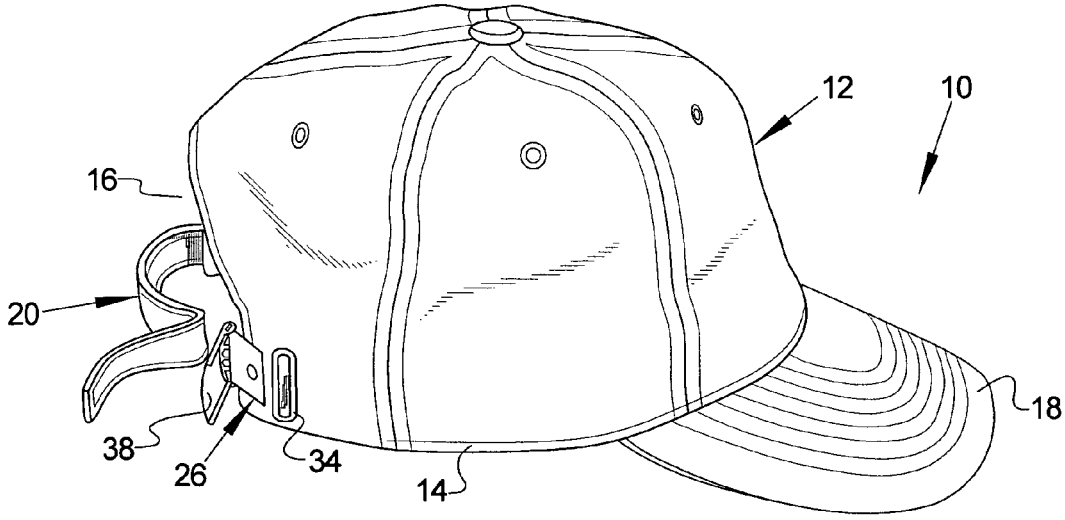
FIG. 2 is a right side perspective view of the adjustable cap of the present invention with the two straps uncoupled.
Figure 3:
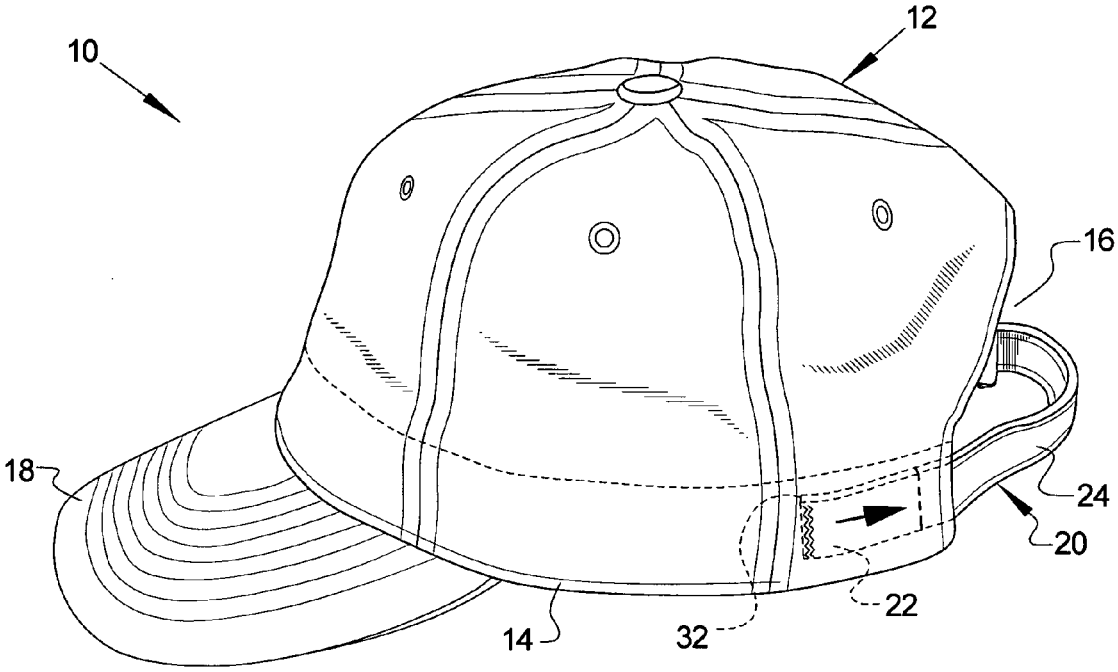
FIG. 3 is a right left perspective view of the adjustable cap of the present invention.
Figure 4:
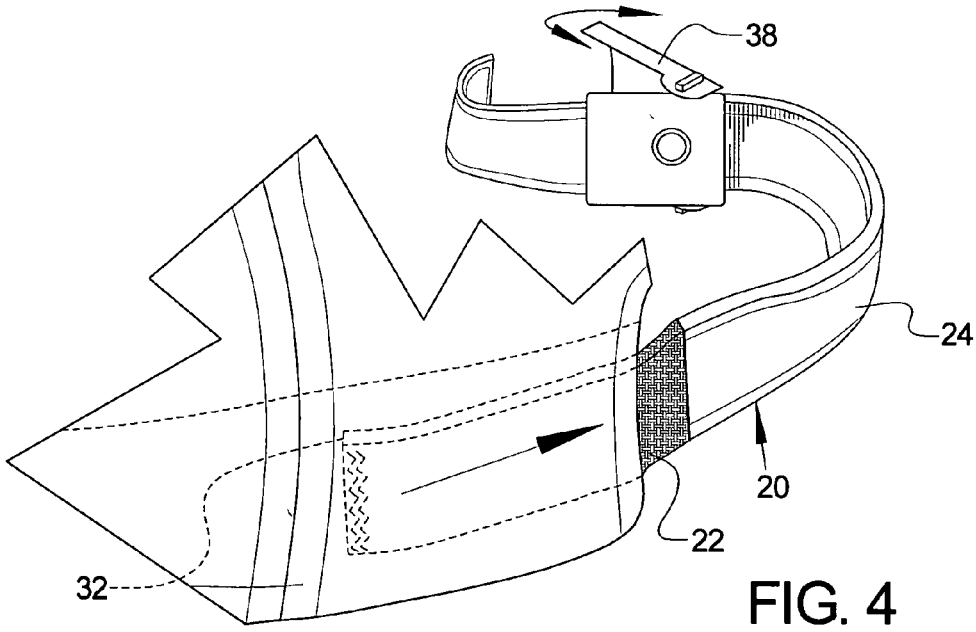
FIG. 4 is a close-up view of the coarse adjustment system and the fine adjustment system used with the adjustable cap of the present invention.
Figure 5:
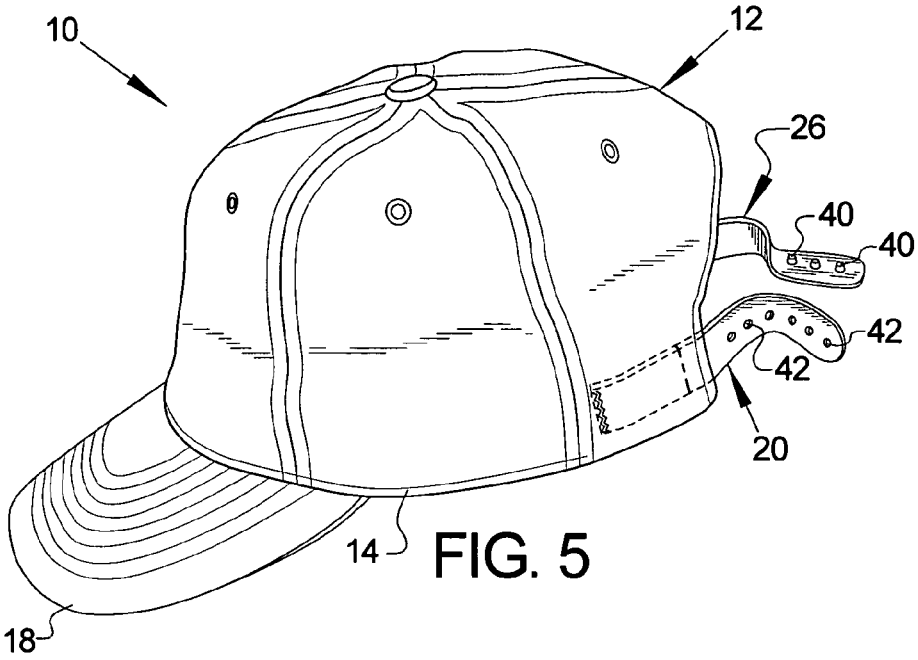
FIG. 5 is a perspective view of an alternate coarse adjustment system used with the adjustable cap of the present invention.

Referring now to the drawings, it is seen that the, adjustable cap of the present invention, generally denoted by reference numeral 10, is comprised of a dome 12 having a lower periphery 14 and an opening 16 located at the lower periphery 14. A bill 18 may be attached to the dome 12 and may be located generally opposite the opening 16 on the dome 12. A first strap 20 is attached to the dome 12 proximate the opening 16, the first strap 20 having a first section 22 made from an elastic material and a second section 24, which may be made from an appropriate cloth material or a suitable hard material such as plastic, depending on the fashion with which the first strap 20 is mateable with a second strap 26, described below, although use of other materials is also anticipated. A second strap 26 is attached to the dome 12 proximate the opening 16 and oriented in spaced apart fashion relative to the first strap 20, the second strap 26 may have a third section 28 that is made from elastic material and a fourth section 30 which may be made from an appropriate cloth material or a suitable hard material such as plastic, depending on the fashion with which the second strap 26 is mateable with a first strap 20, although use of other materials is also anticipated. Alternately, the second strap 26 may be monolithic in construction. The first strap 20 and the second strap 26 are releasably mateable with each other.

The dome 12 may have a first pocket 32 that is located proximate the lower periphery 14 which pocket 32 is openable into the opening 16 such that a portion of the first strap 20 is disposed within the first pocket 32 and is attached to the dome 12 within the first pocket 32. The portion of the first strap 20 which is disposed within the first pocket 32 may be some or all of the first section 22 in order keep the first section 22 out of sight during cap 10 use in so as to give the cap 10 an aesthetic look as the first section 22, being made from an elastic material, may not be as attractive as the second section 24. A second pocket (not illustrated) may be located proximate the lower periphery 14 of the dome 12 and be openable into the opening 16 such that a portion of the second strap 26 is disposed within the second pocket and is attached to the dome 12 within the second pocket. If the second strap 26 is made from a third section 28 which is made from an elastic material and a fourth section 30, it is the third section 28 that may be disposed within the second pocket, some or all of the third section 28, in order keep the third section 28 out of sight during cap 10 use in so as to give the cap 10 an aesthetic look as the third section 28, being made from an elastic material, may not be as attractive as the fourth section 30. Alternately, the third strap 26 may be attached to the dome 12 via the illustrated grommett 34.

Figure 6:
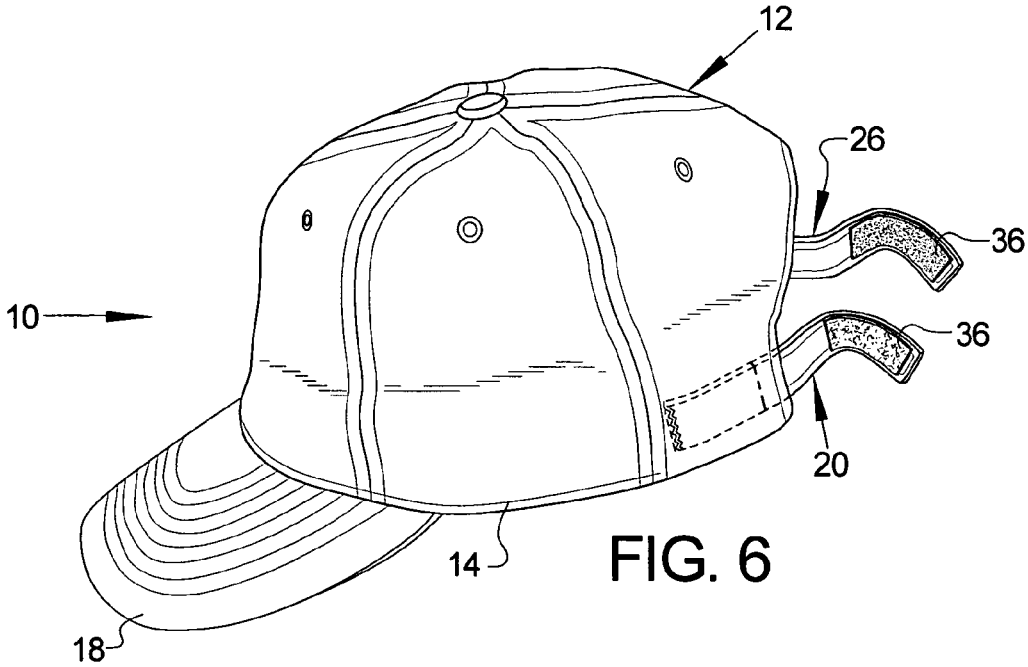
FIG. 6 is a perspective view of a second alternate coarse adjustment system used with the adjustable cap of the present invention.

The first strap 20 may be mateable with the second strap 26 in any standard fashion such as by providing cooperating hook and loop material 36 on each strap, as illustrated in FIG. 6, or the first strap 20 may be mateable with the second strap 26 by providing a buckle 38 of any appropriate design on one of the first strap 20 or the second strap 26 and having the other strap received within the buckle 38, as illustrated in FIGS. 1–4, or the first strap 20 may be mateable with the second strap 26 by providing at least one prong 40 on one of the first strap 20 or the second strap 26 and proving a plurality of receptacles 42 on the other strap such that the at least one prong 40 is receivable within at least one of the plurality of receptacles 42.

In order to use the adjustable cap 10 of the present invention, the first strap 20 is mated with the second strap 26. This mating of the two straps 20 and 26 gives the cap 10 an initial coarse sizing for the wearer. This sizing, once accomplished, is fixed until it is readjusted by the user and is a static system as it does not change unless through the actions of the user. The wearer dons the cap 10 in standard fashion. During use, the first section 22 of the first strap 20, being elastic, stretches and contracts with the shrinking and swelling of the user's head in order to provide a tight fit at all times. As this expansion and contraction sizing of the first section 22 of the first strap 20 occurs automatically, it is dynamic in nature. If the second strap 26 has a third section 28 that is made from an elastic material, this section 28 also expands and contracts with the shrinking and swelling of the wearer's head and also contributes to the dynamic fine sizing adjustment provided. In order for the adjustable cap 10 to work appropriately, it is not necessary for the second strap 26 to have a third section 28 that is made from an elastic material, although for manufacturing expediency, this may be the case.

During use, the first section 22 of the first strap 20 may remain entirely within the first pocket 32, with only the second section 24 of the first strap 20 exposed to sight, so as to give the adjustable cap 10 an aesthetic appeal during use. If the second strap 26 has a third section 28 made from an elastic material, this third section 28 may remain entirely within the second pocket, with only the fourth section 30 of the second strap 26 exposed to sight, so as to give the adjustable cap 10 an aesthetic appeal during use.

While the invention has been particularly shown and described with reference to an embodiment thereof, it will be appreciated by those skilled in the art that various changes in form and detail may be made without-departing from the spirit and scope of the invention.

We claim:

1. An adjustable cap comprising:

a dome having a lower periphery and an opening located at the lower periphery, the dome having a first pocket located on a first side of the opening;

a first strap has a first section made from an elastic material and a second section made from a non-elastic material, the first strap being positioned such that the first section of the first strap is disposed completely within the first pocket and the first section is attached to the dome within the first pocket and such that the second section of the first strap extends outwardly from the pocket and releasably mates with a second strap attached to the dome on a second side of the opening opposite the first side; and wherein the first section of the first strap acts as a fine size adjustment system for the adjustable cap while remaining completely within the first pocket and out of sight whenever the adjustable cap is worn by a user.

2. The adjustable cap as in claim 1 wherein the dome has a second pocket located proximate the lower periphery and openable into the opening such that a portion of the second strap is disposed within the second pocket and is attached to the dome within the second pocket.

3. The adjustable cap as in claim 2 wherein the second strap has a third section made from an elastic material and a fourth section.

4. The adjustable cap as in claim 1 wherein the second strap has a third section made from an elastic material and a fourth section.

5. The adjustable cap as in claim 1 wherein the first strap is mateable with the second strap by providing cooperating hook and loop material on each strap.

6. The adjustable cap as in claim 1 wherein the first strap is mateable with the second strap by providing a buckle on one of the first strap or the second strap and having the other strap received within the buckle.

7. The adjustable cap as in claim 1 wherein the first strap is mateable with the second strap by providing at least one prong on one of the first strap or the second strap and providing a plurality of receptacles on the other strap such that the at least one prong is receivable within at least one of the plurality of receptacle.

8. The adjustable cap as in claim 1 wherein the first strap is mateable with the second strap by selecting a system from the group consisting of cooperating hook and loop material on each strap; providing a buckle on one of the first strap or the second strap and having the other strap received within the buckle; and providing at least one prong on one of the first strap or the second strap and providing a plurality of receptacles on the other strap such that the at least one prong is receivable within at least one of the plurality of receptacle.

9. The adjustable cap as in claim 1 wherein the dome has a second pocket located proximate the lower periphery and openable into the opening and such that the second strap has a third section made from an elastic material and a fourth section made from a non-elastic material, the second strap being positioned such that the third section of the second strap is disposed completely within the second pocket and the third section is attached to the dome within the second pocket and such that the fourth section of the second strap extends outwardly from the pocket and mates with a first strap.

10. The adjustable cap as in claim 9 wherein the first strap is mateable with the second strap by providing cooperating hook and loop material on each strap.

11. The adjustable cap as in claim 9 wherein the first strap is mateable with the second strap by providing a buckle on one of the first strap or the second strap and having the other strap received within the buckle.

12. The adjustable cap as in claim 9 wherein the first strap is mateable with the second strap by providing at least one prong on one of the first strap or the second strap and providing a plurality of receptacles on the other strap such that the at least one prong is receivable within at least one of the plurality of receptacle.

13. The adjustable cap as in claim 9 wherein the first strap is mateable with the second strap by selecting a system from the group consisting of cooperating hook and loop material on each strap; providing a buckle on one of the first strap or the second strap and having the other strap received within the buckle; and providing at least one prong on one of the first strap or the second strap and providing a plurality of receptacles on the other strap such that the at least one prong is receivable within at least one of the plurality of receptacle.

* * * * *